US012636561B2

(12) United States Patent
Anderson

(10) Patent No.: US 12,636,561 B2
(45) Date of Patent: May 26, 2026

(54) GAME FOR INDOOR AND OUTDOOR USE

(71) Applicant: Errol Anderson, Denver, CO (US)

(72) Inventor: Errol Anderson, Denver, CO (US)

( * ) Notice: Subject to any disclaimer, the term of this patent is extended or adjusted under 35 U.S.C. 154(b) by 0 days.

(21) Appl. No.: 17/075,079

(22) Filed: Oct. 20, 2020

(65) Prior Publication Data

US 2022/0118329 A1 Apr. 21, 2022

(51) Int. Cl.
*A63B 67/06* (2006.01)

(52) U.S. Cl.
CPC ..... *A63B 67/06* (2013.01)

(58) Field of Classification Search
CPC ..... A63B 67/06
See application file for complete search history.

(56) References Cited

U.S. PATENT DOCUMENTS 1,325,436 A * 12/1919 Cressman ..... A63B 63/08 273/342
2,747,875 A * 5/1956 Martin ..... A63B 67/06 273/397
4,877,256 A * 10/1989 Falloon ..... A63B 67/06 273/400
4,968,041 A 11/1990 Calvo
D401,308 S 11/1998 D'Emidio
6,341,780 B1 * 1/2002 Pant ..... A63B 67/06 273/400
6,474,651 B1 11/2002 Rivera
6,866,268 B2 * 3/2005 Christianson ..... A63B 65/10 273/DIG. 26
7,325,807 B1 * 2/2008 Eason ..... A63F 7/0005 273/342
7,845,644 B2 * 12/2010 Constantine ..... A63B 67/06 273/317.6
D645,520 S 9/2011 Dahl
D706,353 S 6/2014 Montenare
D706,354 S 6/2014 Montenare
D706,355 S 6/2014 Montenare
8,905,406 B2 * 12/2014 Brown ..... A63B 67/002 273/400
9,199,149 B2 * 12/2015 Max ..... A63B 63/08
(Continued)

FOREIGN PATENT DOCUMENTS

JP 2004121598 A 4/2004

OTHER PUBLICATIONS

Oddity Mall, "Beer Pong Golf: Chip Golf Balls Onto a Cornhole Board", odditymall.com/beer-pong-golf, published Aug. 9, 2017 (Year: 2017).*
Beer Pong All-Stars, "Trick Shot—Rules of Beer Pong #18", beerpongall-stars.com/2015/10/22/trick-shot-rules-of-beer-pong-18/, posted online Oct. 22, 2015 (Year: 2015).*
CustomOutdoorGame, "Single Golf Pong/Beer Pong", https://www.etsy.com/listing/659898073/single-golf-pong-beer-pong-custom-built, on sale as of Jun. 19, 2019 (Year: 2019).*
(Continued)

*Primary Examiner* — Jeffrey S Vanderveen
(74) *Attorney, Agent, or Firm* — Inspired Idea Solutions, LLC

(57) ABSTRACT

A game for indoor or outdoor use is disclosed. The game includes a game board with one or more holes. One or more cups are configured in the holes. The game board may be inclined. A second game board with one or more cups may be disposed oppositely the game board. Players, standing oppositely, may throw playing pieces into the one or more cups in each game board. Different point values may be awarded for playing pieces landing in each cup, or for playing pieces not landing in a cup. Some cups may be associated with a specific scoring or game function.

6 Claims, 5 Drawing Sheets

(56) References Cited

U.S. PATENT DOCUMENTS

| | | | | |
|---|---|---|---|---|
| 9,782,666 | B2 * | 10/2017 | Dahl | A63B 69/40 |
| D808,465 | S | 1/2018 | Wolters | |
| D859,529 | S | 9/2019 | Burris | |
| D876,548 | S | 2/2020 | Wolters | |
| 2007/0001399 | A1 | 1/2007 | Staver | |
| 2014/0027983 | A1 | 1/2014 | Keebler | |
| 2014/0264138 | A1 * | 9/2014 | Bell | F16K 1/427 251/364 |
| 2014/0265136 | A1 | 9/2014 | Parker | |
| 2014/0265138 | A1 * | 9/2014 | Esposito | A63B 67/06 273/400 |
| 2015/0108719 | A1 * | 4/2015 | Devine | A63B 63/08 273/402 |
| 2016/0038808 | A1 | 2/2016 | Lombardi | |
| 2017/0128806 | A9 * | 5/2017 | Breslin | A63F 7/00 |
| 2019/0054359 | A1 | 2/2019 | Saleeby | |
| 2020/0047060 | A1 * | 2/2020 | Bauer | A63F 7/0668 |
| 2020/0147465 | A1 | 5/2020 | Chille | |
| 2020/0306603 | A1 * | 10/2020 | Burns | A63B 67/06 |

OTHER PUBLICATIONS

Urban Dictionary, "Black Hole Beer Pong Rule", https://www.urbandictionary.com/define.php?term=Black Hole Beer Pong Rule., posted on May 3, 2020 (Year: 2020).*

The MegaPongoChannel, "Megapongo Official Video," www.youtube.com/watch?v=YjPoCCZR4rg (Year: 2013).*

Versapong Portable Beer Pong Table, https://www.amazon.com/Versapong-Portable-Table-Tailgate-Backpack/dp/B00RSOKJF2, release date May 5, 2020 (Year: 2020).*

Versapong Portable Beer Pong Table/Tailgate Game, with product reviews dating to May 10, 2016, https://www.amazon.com/Versapong-Portable-Table-Tailgate-Backpack/product-reviews/B00RSOKJF2/ref=cm_cr_arp_d_viewopt_mdrvw?mediaType=media_reviews_only&pageNumber=1 (Year: 2016).* https://www.wayfair.com/outdoor/pdx/beer-pong-golf-2-x-4-the-original-solid-wood-cornhole-board-bpgf1004.html; Green 2'×4' The Original Solid Wood Cornhole Board; Date Accessed Jul. 30, 2020.

* cited by examiner

GAME FOR INDOOR AND OUTDOOR USE

TECHNICAL FIELD

This disclosure relates to games for amusement, and more specifically to games for indoor and outdoor use.

BACKGROUND

People who play games often do so for amusement, such as in group activities. It is desirable for games to be challenging and fun for players of the game. Further, a game may test the skill of the players or require strategy to win the game. A game may have a physical component (e.g., requiring physical activity) which may be performed by players of any age. A game may require some degree of set up in order to be played.

The above characteristics of gameplay may be optimized to engage players, provide simplicity of set up and add diversity to gameplay.

SUMMARY

A game is disclosed which includes a game board having one or more holes extending into the board, one or more cups removably arranged on the game board and extending into the holes, and one or more playing pieces sized to fit within the one or more cups, wherein each of the one or more playing pieces may be thrown from a distance, and wherein each of the one or more cups may receive the one or more playing pieces when thrown.

A game is disclosed which includes a first game board having one or more holes extending into the board, a second game board having one or more holes extending into the board, the second game board configured oppositely the first game board, a first group of one or more cups removably arranged on the first game board and extending into the holes, a second group of one or more cups removably arranged on the second game board and extending into the holes, a first set of one or more playing pieces sized to fit within the first group of one or more cups, and a second set of one or more playing pieces sized to fit within the one or more second group of one or more cups, wherein the first and second sets of one or more playing pieces may be thrown from a distance, and wherein the first and second groups of the one or more cups may receive corresponding ones of the first and second sets of one or more playing pieces when thrown.

A method of gameplay is disclosed including placing a game board having one or more holes on a supporting surface, placing one or more cups on the game board to extend from the holes, and throwing one or more playing pieces from a distance toward the one or more cups, the one or more playing pieces sized to fit within the one or more cups.

DETAILED DESCRIPTION

Figure 1:
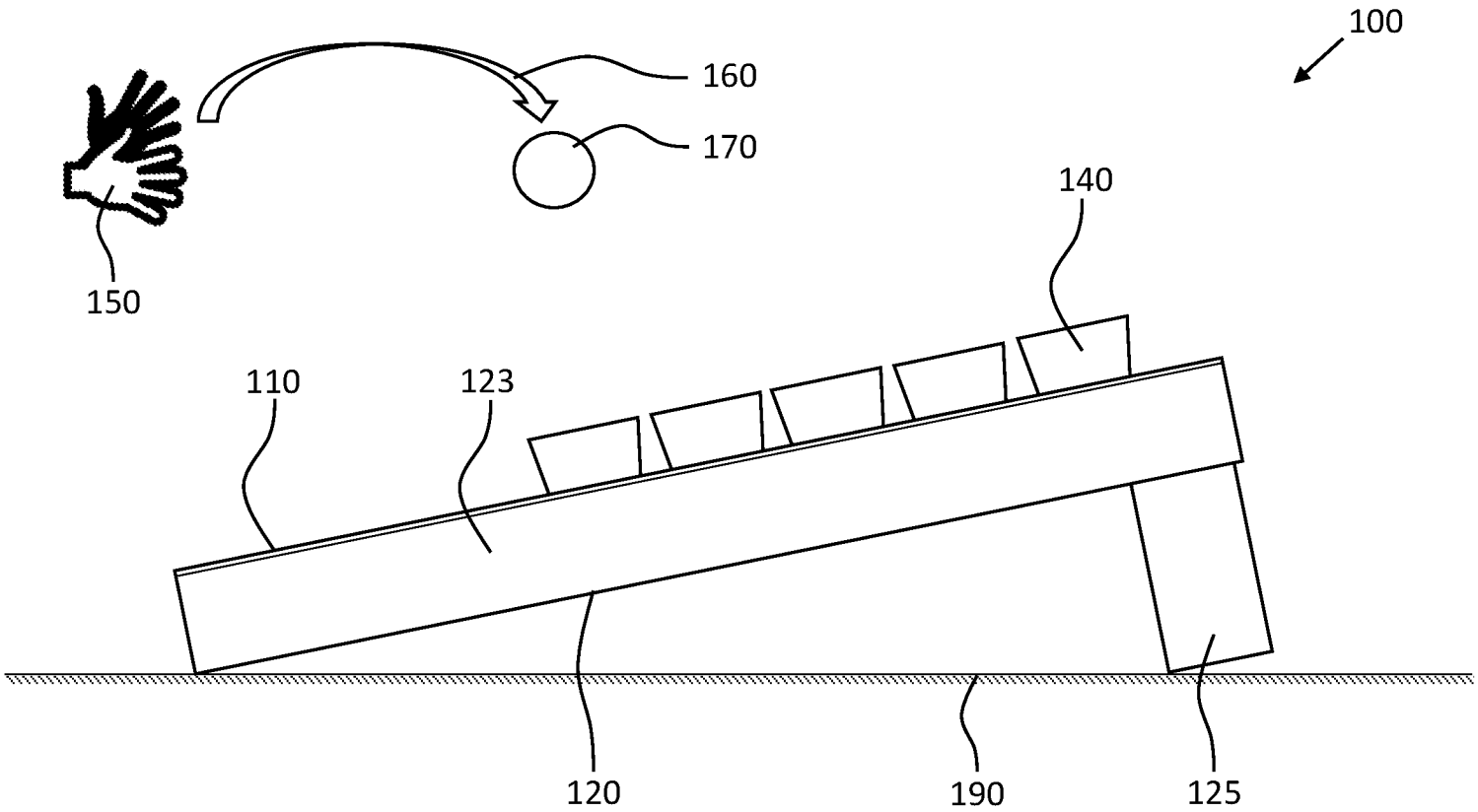
FIG. 1 is a side view of game.

FIG. 1 illustrates a game 100 including a game board 110, supporting structure 120, and one or more cups 140. Game board 110 may be inclined with respect to a supporting surface 190 (e.g., the ground). Generally, supporting surface 190 may be horizontal, though game 100 may be operable where supporting surface 190 is inclined with respect to a horizontal plane. Further, game board 110 may be flat (e.g., as illustrated in FIG. 1), or may have contours to reduce the predictability of gameplay. Game board 110 may be thin and/or capable of some flexibility during gameplay and/or game board 110 may be thick enough to withstand contact by objects without flexing.

Supporting structure 120 may be added to secure game board 110 in place and/or provide other features. Supporting structure 120 may include a perimeter portion 123 (e.g., extending around a perimeter of game board 110) and/or one or more legs 125. Supporting structure 120 may enable game board 110 to be inclined with respect to supporting surface 190 (e.g., a horizontal surface). The one or more legs 125 may be configured to support game board 110 at an incline with respect to supporting surface 190 (e.g., a deck). The one or more legs 125 may extend from perimeter portion 123 and/or away from game board 110 to supporting surface 190 (e.g., downwardly). Where game board is rectangular (e.g., having 4 corners), at least two legs 125 may extend from adjacent corners, such that game board 110 may be inclined with respect to supporting surface 190 (e.g., two adjacent corners rest on supporting surface 190, and two adjacent corners are suspended by legs 125). A person of ordinary skill in the art will appreciate that additional variations are possible to configure game board 110 at an incline to supporting surface 190.

One or more cups 140 may extend from game board 110 (e.g., 1, 2, 3, 4, 5, 6, 7, 8, 9, 10, 11, 12, 13, 14, 15, 16, or more cups). The one or more cups 140 may be positioned closely such that a playing piece 170 (e.g., a ball), when thrown (e.g., along path 160) by a player 150 (e.g., hand-thrown), may be prevented from contacting game board 110 at a position between two adjacent cups 140. The one or more cups 140 may be positioned remotely such that a playing piece 170 (e.g., a bag), when tossed (e.g., along path 160) by a player 150 (e.g., using a throwing device), may be able to contact game board 110 at a position between two adjacent cups 140. Further, game board 110 may have region(s) with relatively high density of cups and/or region(s) with relatively low density of cups (e.g., cups may be positioned in any configuration on game board 110).

While it is not clear from the view represented in FIG. 1, the one or more cups 140 may have a circular cross section with a central axis (e.g., an axis of symmetry) extending at an incline with respect to game board 110 (e.g., extending normally). Nevertheless, the one or more cups 140 may have other cross-sectional shapes (e.g., symmetric or asymmetric). Further, the central axis of the one or more cups may extend from game board 110 at any angle (e.g., each at identical and/or different angles).

While only one playing piece 170 is illustrated (e.g., a ping pong ball), a person of ordinary skill in the art will appreciate that gameplay may require the use of a plurality of playing pieces 170 (e.g., 2, 3, 4, 5, 6, 7, 8, 9, 10, 11, 12, 13, 14, 15, 16, or more playing pieces). Playing pieces 170 (e.g., golf balls) may be sized so that only one playing piece 170 can fit in each cup 140 at a time. Playing pieces 170 (e.g., marbles) may be sized so that two or more playing pieces 170 can fit in each cup 140 at a time. Playing pieces 170 (e.g., tennis balls) may be formed of any one or more of rigid, perforated, soft, compliant, and/or flexible material (e.g., foam, rubber, and so forth). Playing pieces 170 (e.g., appropriately sized candies) may be shaped uniformly or with great diversity (e.g., one or more of a sphere, cube, cone, cylinder, tetrahedron, toroid, cuboid, triangular prism or pyramid, square pyramid, pentagonal prism or pyramid, hexagonal prism or pyramid, ellipsoid, icosahedron, dodecahedron, other polyhedrons, and so forth). Thus, the number of playing pieces used, the size of the playing pieces used, the material selection of each playing piece, and/or the shape of each playing piece may add variation and complexity to gameplay.

Figure 2:
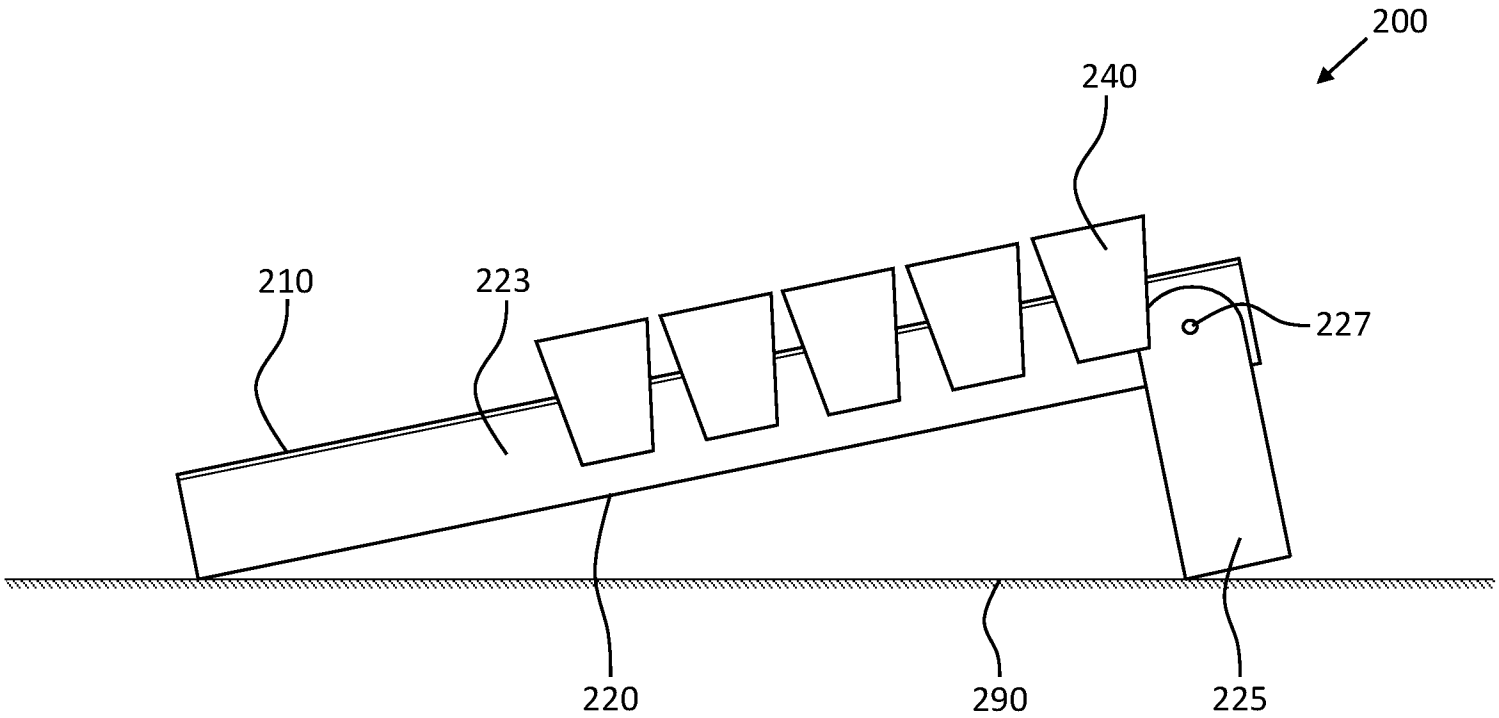
FIG. 2 is a cross sectional view of a game.

FIG. 2 illustrates a game 200 including a game board 210, supporting structure 220, and one or more cups 240. Game board 210 may be inclined with respect to a supporting surface 290 (e.g., living room floor). Supporting structure 220 may include a perimeter portion 223 (e.g., extending around a portion of a perimeter of game board 210) and/or one or more legs 225. The one or more legs 225 may be configured to support game board 210 and/or perimeter portion 223 at an incline with respect to supporting surface 290 (e.g., a patio). The one or more legs 225 may extend at an incline with respect to game board 210 (e.g., normally). The one or more legs 225 may be moveable with respect to game board 210 and/or perimeter portion 223 (e.g., rotatable about pivot 227, translatable, telescoping, or any combination thereof). Thus, the incline between game board 210 and supporting surface 290 may be adjustable to optimize gameplay. A person of ordinary skill in the art will appreciate that additional variations are possible to configure the incline between game board 210 and supporting surface 290.

Game board 210 may have one or more holes extending through game board 210 (e.g., 1, 2, 3, 4, 5, 6, 7, 8, 9, 10, 11, 12, 13, 14, 15, 16, or more holes). One or more cups 240 may extend through game board 210 (e.g., through the one or more holes, as illustrated in FIG. 2). While a cup 240 is illustrated in each hole, a person of ordinary skill in the art will appreciate that less than all of the holes may be occupied by a cup. The one or more cups 240 may have a larger dimension at an open end and further may have a smaller dimension at a closed end. Thus, each cup may be inserted into a corresponding hole of game board 210 until the dimension of the cup matches the dimension of the hole (e.g., until the cup is retained by the hole). Thus, the one or more cups 240 may extend partially above game board 210 and/or may extend partially below game board 210. The one or more cups 240 may be interchangeable, such that any of the one or more cups 240 may be placed in any hole. Thus, gameplay may be optimized by changing the location of each of the one or more cups 240 used during gameplay, as will be further understood below.

Figure 3:
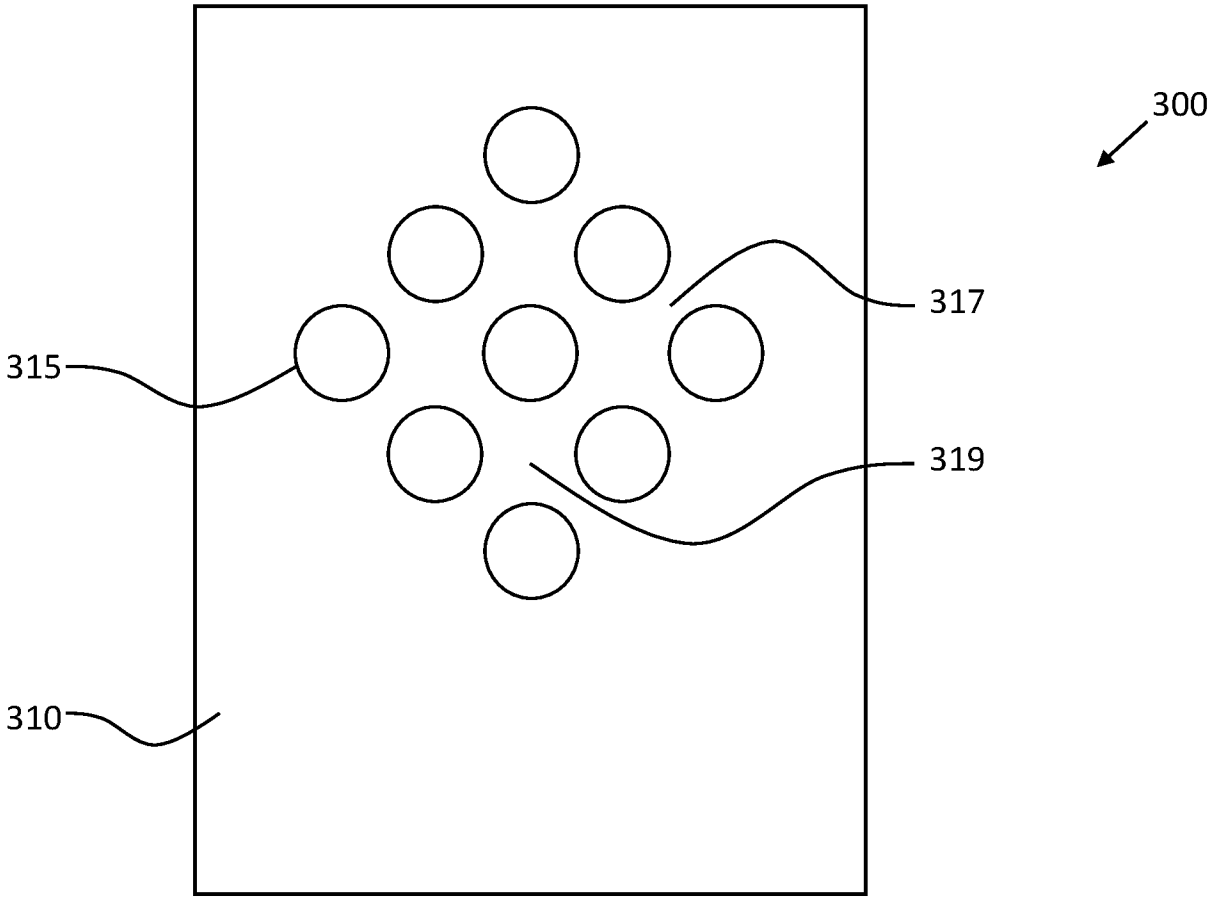
FIG. 3 is a top view of a game.

FIG. 3 illustrates a game 300 including a game board 310 configured with one or more holes 315. The one or more holes 315 may extend partially or entirely through game board 310. Further, the one or more holes 315 may form a pattern of holes (e.g., such as a diamond pattern, as illustrated in FIG. 3, where a plurality of holes collectively form diamond shape, such as represented by a 1-2-3-2-1 format). Nevertheless, a person of ordinary skill in the art will appreciate that various patterns are possible consisting of any number of holes (e.g., shapes including any one or more of triangle, square, pentagon, parallelogram, circle, crescent, cross, star, oval, rhombus, pentagon, hexagon, or other polygonal shape and including between 1 and 50 or more holes).

The one or more holes 315 may be configured relatively close together on game board 310, or may be spread out throughout game board 310. The one or more holes 315 may have small gaps 317 (e.g., corresponding to cups positioned to prevent a playing piece from contacting game board 310 in the small gaps 317), and/or large gaps 319 (e.g., corresponding to cups positioned to allow a playing piece to contact game board 310 in the large gaps 319). In general, the game board 310 may be configured to be any appropriate size. Game board 310 may be between one and 5 feet wide and/or between 1 and 5 feet long (e.g., 2 feet wide and/or 3 feet long).

Figure 4:
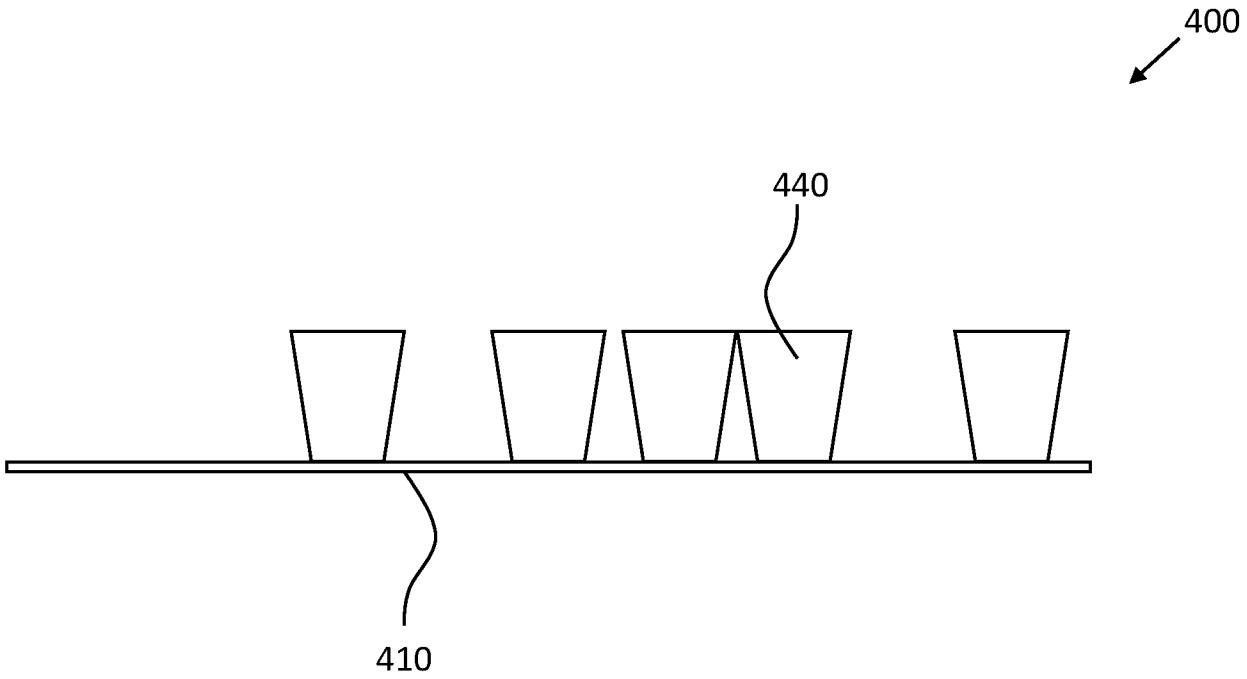
FIG. 4 is a side view of a game.

FIG. 4 illustrates a game 400 including a game board 410 configured with one or more cups 440. In this configuration, the one or more cups 440 may be placed in any orientation on game board 410 without respect to holes (e.g., the one or more holes 315 of FIG. 3). Thus, the one or more cups 440 may be placed randomly or in any other configuration taught in this disclosure. The one or more cups 440 may be clustered, spread out, touching each other or not, positioned internally or near a perimeter of game board 410, and so forth. While not illustrated, a person of ordinary skill in the art will appreciate that the one or more cups 410 may be positioned both on and through holes of game board 410 (e.g., such that some of the one or more cups 440 are lower compared to other of the one or more cups 440). Further, game board 410 may be configured horizontally and/or without any incline with respect to a supporting surface (e.g., supporting surface 190 of FIG. 1).

Figure 5:
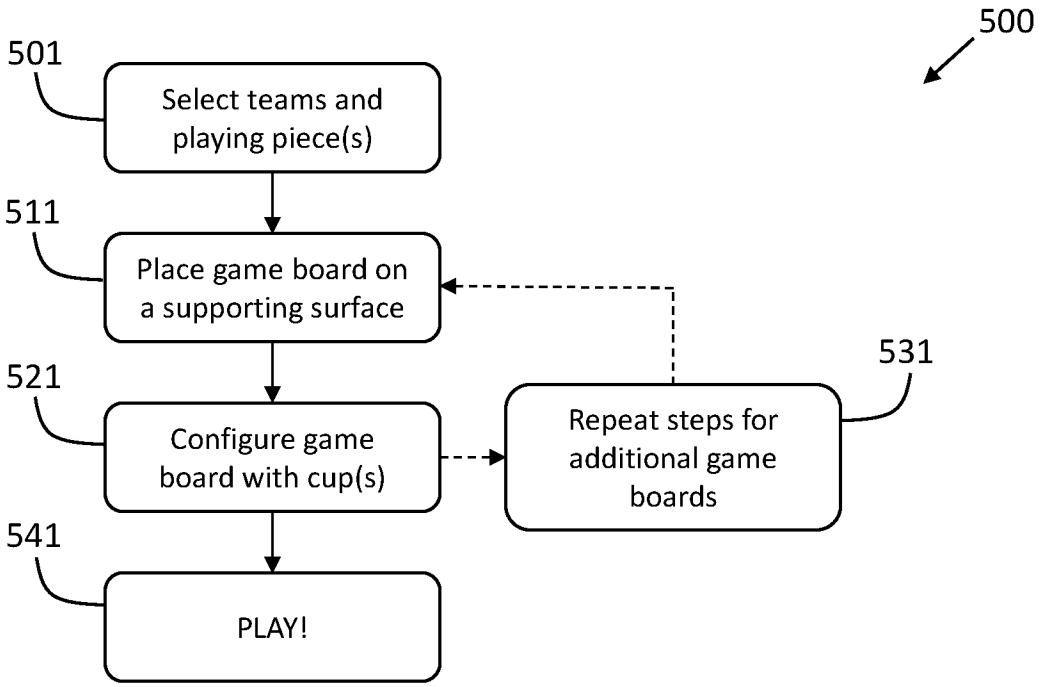
FIG. 5 is a block diagram of a method of gameplay.

A method 500 of gameplay is illustrated in FIG. 5. In step 501, teams and playing pieces may be selected. For solo play (e.g., play by a single player), proceed to step 511. Where two or more players are to play, players may be divided into two or more teams (e.g., 2, 3, 4, 5, or more teams). Employing the use of teams during gameplay has a number of benefits, one or more of which may include facilitation of idea generation and creativity, increased productivity, boosted morale and motivation, increased comfort with taking risks, heightened learning, stress relief, improved relationships, not to mention some good ol' fashion fun. Therefore, each team may consist of one or more players (e.g., 1, 2, 3, 4, 5, or more players on each team).

Each team may be assigned its own playing piece or set of playing pieces. Playing pieces may be discernable so that they may be associated with the team to which it is assigned. Playing pieces may each be a different color, or each set of playing pieces may be a different color corresponding to each team. Playing pieces may be numbered, or each set of playing pieces may be numbered with the number or range of numbers corresponding to each team. Playing pieces may be lettered, or each set of playing pieces may be lettered with the letter or range of letters corresponding to each team. Playing pieces may be named (e.g., bearing a team name).

In step 511, the game may be configured on a supporting surface. As the game is capable of either indoor or outdoor use, the game may be configured on any supporting surface. Optionally, one or more legs may be extended from the game to facilitate inclined gameplay (e.g., such that the game board may be inclined with respect to the supporting surface).

In step 521, the game may be configured with a cup or cups. Each cup may be positioned on the game board or within holes in the game board (e.g., extending at least partially above the game board and/or partially below the game board). Each cup may be assigned a point value and/or a group of cups may be assigned the same point value. The placement of cups, or groups of cups, of a particular point value may be in accordance with a particular pattern (e.g., ascending point values from one side of the game board to the other side, or highest point cup in the center with cups of progressively lower point value radiating outward toward the game board perimeter, and so forth), or may be completely random. A person of ordinary skill in the art will appreciate that many configurations are possible, and indeed, one advantage of the game as disclosed is the wide range of variability of placement of cups having different point values.

Further, it may be advantageous to designate point values of each cup, or group of cups, to make it easy for players to know which cups have which point values. Cups may each be a different color, or each group of cups may be a different color where each color corresponds to a different point value. Cups may be numbered, or each group of cups may be numbered with the point value. A person of ordinary skill in the art will appreciate that numerous means exist for designating point values of a cup or group of cups.

In a specific example, a first group of cups may be worth 6 points each, a second group of cups may be worth 4 points each, a third group of cups may be worth 2 points each, a fourth group of cups may be worth 1 point each, and a fifth group of cups may be associated with one or more game or scoring functions (e.g., cancelling points obtained on the last throw).

While step 521 is shown following step 511, and before step 541, it may enhance gameplay for players to have the option to switch or reconfigure the placement of cups during gameplay. Cups may be reconfigured between each round of gameplay (e.g., after each team has had a turn to throw one or more playing pieces). Each team may have an opportunity to reconfigure cups during a single game. Cups may be reconfigured upon the occurrence of an event during gameplay. A player, or team, who lands a playing piece in a specified cup may have the option to switch cups (e.g., the specified cup and any other cup, any two cups, any three cups, and so forth). A player, or team, who lands two or more playing pieces in a single cup may have the option to switch two or more cups. Any other event occurring during gameplay may be specified as a condition to enable reconfiguration of any cups used in gameplay (e.g., completion of another beverage).

In step 531, steps 511 and 521 may be repeated, in whole or in part, to facilitate enhanced gameplay. A second game board may be configured on a supporting surface. The second game board may correspond to a second team, positioned oppositely the first game board (e.g., and a third game board may correspond to a third team, positioned in an opposing triangular configuration, and so forth with each team having their own board). Team members may be split between each game board, such that each team has at least one player designated to throw playing pieces onto each game board (e.g., such that players from each team may interfere with the gameplay of players from other teams). Thus, step 531 may be repeated to accommodate the number of teams and/or the number of players on each team. In its simplest form of team play, the game may consist of two game boards configured oppositely with two team (e.g., each team having two players positioned oppositely). In general, two game boards are considered to be positioned oppositely when they may be spaced apart by a specified distance, such as between 5 and 25 feet apart (e.g., 15 feet). The two game boards may also be inclined toward each other (e.g., facing each other).

In step 541, players and/or teams initiate gameplay. The team going first may be selected based on any number of criteria (e.g., one or more of age, most recent vacation, team having won the last game, team having lost the last game, coin toss, and so forth). During gameplay, playing pieces are thrown by players (e.g., attempting to land playing pieces into the cups). Points may be awarded based on a playing piece landing in a cup having an assigned point value. The player going first (e.g., a first player from a first team) may throw their playing pieces (e.g., 5 playing pieces), after which a player going second (e.g., a second player from a second team) may throw all of their playing pieces. A round of play may include each player from a first team throwing all their playing pieces, then each player from a second team throwing all their playing pieces. A round of play may include a first player from a first team throwing his/her playing pieces, followed by a first player from a second team, then a second player from the first team, then a second player from the second team. A round of play may include each player throwing in a single direction throwing a first playing piece, followed by each player throwing in a single direction throwing a second playing piece, and so forth until all throwing pieces have been thrown.

The manner in which a round is executed during gameplay may enable players to interfere with each other's gameplay or points received for successfully landing playing pieces in cups of a particular point value. Playing pieces from opposing teams which land in the same cup may cancel each other out. Points for a cup may be awarded to the player or team having the most playing pieces in a particular cup. Playing pieces landing and remaining on the game board (e.g., wedged between cups) may be awarded a point value (e.g., half the lowest cup point value, or the value of any cups it is touching, and so forth). Cups may be given negative point values. Cups may be associated with other game or scoring functions (e.g., reconfiguring cups, loss of any points gained on the last throw, loss of any points gained on that turn, loss of a turn, extra turn, loss of playing pieces until the next round, extra playing pieces, and so forth). Further, any playing piece that returns to the player throwing it after it is thrown may be available to be thrown again during the same round of gameplay (e.g., retrievable without crossing between two or more game boards). Thus, gameplay may be enhanced and optimized to improve player satisfaction.

Gameplay may cease after a predetermined number of rounds of play, or after a score equal to or in excess of a threshold score is achieved, or after a winning score is achieved exactly. Where an exact score is required to win, any team exceeding the winning score may restart at an intermediate threshold (e.g., where a winning score is 50, any team score above 50 may cause the team to start back at 30, after which normal gameplay resumes).

The illustrations and discussions in this disclosure are presented as examples to teach principles and elements of the game and gameplay. Variations in shape, size, material, function and operation are considered to be within the scope of this disclosure. A person of ordinary skill in the art will appreciate that variations may be practiced without departing from the spirit and scope of this disclosure.

The invention claimed is:

1. A method of playing a game, the method comprising:

placing a game board having three or more holes on a supporting surface, the game board placed at an incline with respect to the supporting surface;

placing three or more cups on the game board to extend from the three or more holes, wherein about half the height of the three or more cups extends above the game board to form one or more small gaps and one or more large gaps; and throwing one or more playing pieces from a distance toward the three or more cups, the one or more playing pieces sized to fit within the one or more large gaps and prevented from passing between adjacent ones of the three or more cups by rolling down the incline into the one or more small gaps, the one or more playing pieces sized to fit within the three or more cups.

2. The method of claim 1, wherein some of the three or more cups are assigned similar or different point values, such that points may be awarded for playing pieces which land in any of the three or more cups.

3. The method of claim 2, wherein playing pieces from opposing teams which land in the same of the three or more cups cause point values to be cancelled out.

4. The method of claim 1, wherein some of the three or more cups are assigned a game or scoring function, including one or more of reconfiguring cups, loss of any points gained on a last throw, loss of any points gained on that turn, loss of a turn, extra turn, loss of playing pieces until a next round, and extra playing pieces, and switching cup locations.

5. The method of claim 1, wherein point values are awarded for playing pieces which land on and remain on the game board.

6. The method of claim 1, wherein a returning playing piece is rethrown.

* * * * *